US007025657B2

(12) United States Patent
Nishimoto

(10) Patent No.: US 7,025,657 B2
(45) Date of Patent: Apr. 11, 2006

(54) ELECTRONIC TOY AND CONTROL METHOD THEREFOR

(75) Inventor: Tetsuo Nishimoto, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/013,096

(22) Filed: Dec. 6, 2001

(65) Prior Publication Data

US 2002/0077028 A1 Jun. 20, 2002

(30) Foreign Application Priority Data

Dec. 15, 2000 (JP) ..... 2000-381758

(51) Int. Cl.
*A63H 29/22* (2006.01)

(52) U.S. Cl. ..... 446/484; 446/298; 446/353; 446/175; 446/301; 434/308

(58) Field of Classification Search ..... 446/484, 446/175, 297, 353
See application file for complete search history.

(56) References Cited

U.S. PATENT DOCUMENTS 5,746,602 A * 5/1998 Kikinis ..... 434/169
5,752,880 A * 5/1998 Gabai et al. ..... 463/1
6,012,961 A * 1/2000 Sharpe et al. ..... 446/298
6,149,490 A * 11/2000 Hampton et al. ..... 446/353
6,206,745 B1 * 3/2001 Gabai et al. ..... 446/91
6,253,058 B1 * 6/2001 Murasaki et al. ..... 434/308
6,290,566 B1 * 9/2001 Gabai et al. ..... 446/175
6,319,010 B1 * 11/2001 Kikinis ..... 434/169
6,497,604 B1 * 12/2002 Fong et al. ..... 446/297
6,585,556 B1 * 7/2003 Smirnov ..... 446/175

FOREIGN PATENT DOCUMENTS

| | | |
|---|---|---|
| JP | 5-29596 | 4/1993 |
| JP | 09-322273 | 12/1997 |
| JP | 2001-157981 | 6/2001 |
| JP | 2001-242780 | 9/2001 |
| WO | WO 00/53281 | 9/2000 |

* cited by examiner

*Primary Examiner*—Boyer D. Ashley
*Assistant Examiner*—Ali Abdelwahed
(74) *Attorney, Agent, or Firm*—Morrison & Foerster LLP

(57) ABSTRACT

Electronic toy receives control information via an input interface and stores the received control information in memory. The electronic toy includes at least one sensor for detecting an external stimulus applied to the toy, and control information is read out from the memory in response to an external stimulus detection signal generated by the sensor so that the electronic toy is controlled to perform a predetermined operation in accordance with the read-out control information. It is possible to readily renew operations that can be performed by the electronic toy, by, for example, downloading desired control information from a server via a communication line and then storing the desired control information in an internal memory of the toy.

13 Claims, 5 Drawing Sheets

| SENSOR TYPE | OPERATION TYPE |
|---|---|
| A | — |
| A+B | a(1) |
| A+C | a(2) b(1) |
| A+B+C | UNDETERMINED |
| B | c(1) |
| B+C | b(2)c(2) |
| C | a(3) c(1) |

FIG. 6A

| SENSOR TYPE | OPERATION TYPE |
|---|---|
| A+B | a(5) |
| A+B+C | a(6)b(3) |
| D | c(3) |

FIG. 6B

ELECTRONIC TOY AND CONTROL METHOD THEREFOR

BACKGROUND OF THE INVENTION

The present invention relates generally to electronic toys which, on the basis of a prestored program, selectively perform a predetermined operation in response to an external factor or a state of the toy, and methods for controlling the electronic toys. More particularly, the present invention relates to an improved electronic toy which can freely replace a program, toy-operation-related information or other content with other or new content via a communication terminal and can perform an operation on the basis of the other content.

Electronic toys have been known which, in response to an external factor or a state of the toy detected by one or more built-in sensors, execute a program stored in a storage device and make a motion or produce a sound in accordance with the program. For example, the known electronic toys use an acceleration sensor to detect an amount, velocity, direction, etc. of each motion of the toy, an inclination sensor to detect a posture or orientation of the toy, an infrared sensor to detect whether or not there is any person around the toy, a piezoelectric (touch) sensor to detect whether or not a force greater than a predetermined value has been applied to the toy or detect a level of a force applied to the toy, a photo sensor to detect light (or variation in light) greater than a predetermined level around the toy or a shape of an object present around the toy, and a sound sensor to detect whether or not there has been produced a sound greater than a predetermined level around the toy or detect a type of such a sound. In this way, the electronic toys each can detect an external factor having occurred around the toy or a particular state of the toy via any of the sensors, and create operation information corresponding to the type of the sensor having detected such an external factor or a state.

In recent years, more sophisticated electronic toys have come on the scene, which are arranged to appear as if they were growing up and gradually learning new operations to be performed. Specifically, to this end, a stepwise changeover is made between programs for causing the toy to perform various operations (e.g., by making motions and producing sounds) in response to detection by various sensors as noted above, taking into account an elapsed time, the types of the programs or the number of times the current program has been executed, so as to sequentially vary the motions and sounds that can be made and produced by the toy.

Each of the conventional electronic toys is designed to make motions and produce sounds merely in accordance with the prestored programs. Thus, the electronic toy tends to readily become boring or uninteresting to a user, so that the user generally does not play with the same toy for a long period of time. As a consequence, the conventional electronic toys would unavoidably have short life as products.

One possible approach for avoiding the above-discussed problem is to prestore a great many content, such as programs and information related to operations to be performed by the electronic toy. However, in this case, the electronic toy has to be equipped with a storage device having an extremely great capacity, which thus creates a new problem that the manufacturing costs of the toy increase considerably.

SUMMARY OF THE INVENTION

In view of the foregoing, it is an object of the present invention to provide an electronic toy which can use various content, such as programs and/or toy-operation-contents-related information while freely replacing the content with other desired content.

In order to accomplish the above-mentioned object, the present invention provides an electronic toy which comprises: at least one sensor that detects an external stimulus applied to the electronic toy; an input interface that receives, from outside the electronic toy, control information for controlling the electronic toy; a memory that stores the control information received via the input interface; and a processor coupled with the memory. The processor is adapted to: read out control information from the memory, in response to an external stimulus detection signal generated by the sensor; and control the electronic toy to perform a predetermined operation in accordance with the control information read out from the memory.

According to the present invention, the electronic toy can receive appropriate control information from outside the toy (information source external to the toy) and store the received control information in the memory, so that a predetermined operation of the toy can be controlled in accordance with the thus-stored control information. Namely, the electronic toy includes an input interface that receives information from outside the toy, and control information received via the input interface is stored in the memory. The control information is read out from the memory in response to an external stimulus detection signal output by the sensor so that the electronic toy is controlled to perform a predetermined operation in accordance with the read-out control information. With such arrangements that control information received from outside the toy is stored in the memory and read out from the memory in response to an external stimulus applied to the toy so that operation of the toy is controlled on the basis of the control information. Thus, the electronic toy is allowed to readily perform a new operation, by storing other externally-input control information in place of or in addition to control information already stored in the memory.

In one preferred embodiment of the present invention, the input interface has a communication function. The electronic toy of the invention is connected, via the communication interface, to an external communication terminal such as a mobile cellular phone, and receives, via the communication terminal, desired control information from a server on a communication network. In this way, a user of the electronic toy can readily download desired control information by use of the communication terminal. Thus, the present invention can provide the user with an electronic toy that will not bore the user even if the same toy is used by the user for a long period of time.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIG. 6A is a diagram conceptually showing an exemplary format of a standard toy-operation-contents determining table; and FIG. 6B is a diagram conceptually showing an exemplary format of a rewritable toy-operation-contents determining table.

DETAILED DESCRIPTION OF EMBODIMENTS

Figure 1:
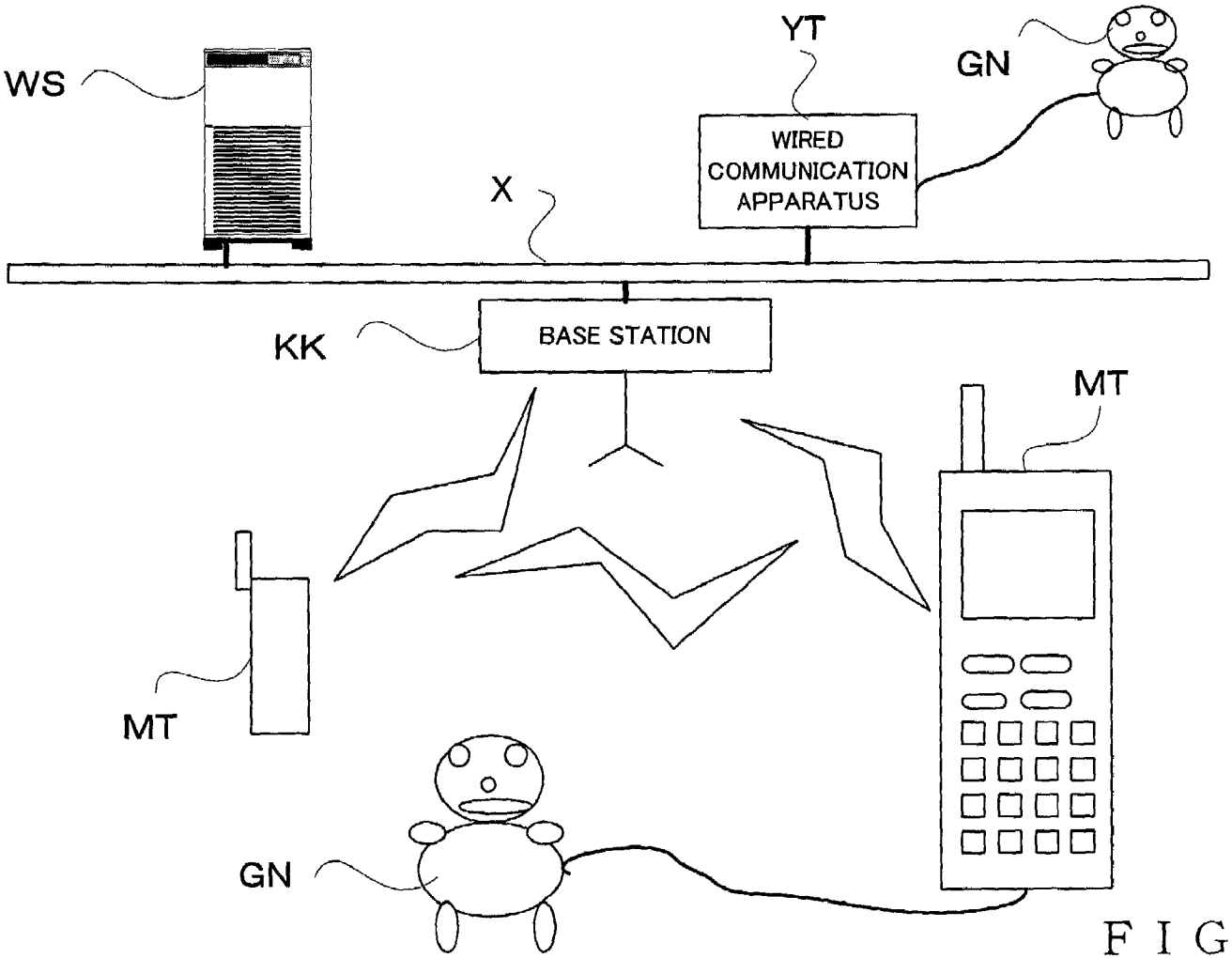
FIG. 1 is a block diagram showing an exemplary general setup of a content delivery system which transmits content to an electronic toy of the present invention.

FIG. 1 is a block diagram showing an exemplary general setup of a content delivery system which transmits content, such as a program or toy-operation-contents-related (i.e., toy-operation-descriptive) information, to an electronic toy of the present invention. This content delivery system includes, in addition to the electronic toy GN capable of ultimately receiving and storing desired content, a portable communication terminal MT, a base station KK, a server WS, a wired communication apparatus YT, and a communication network X. The various apparatus constituting the content delivery system, i.e. the above-mentioned portable communication terminal MT, server WS and wired communication apparatus YT, can communicate various items of content with one another via wired or wireless communication using the communication network X, base station KK, etc. Among the various items of content to be communicated are toy-operation control programs for controlling the electronic toy GN to perform predetermined operations, and performance information prepared in the known MIDI and MP3 formats to be used for producing predetermined words, musical sounds, etc. on the basis of the toy-operation control programs.

Although the content delivery system may include other hardware components than the above-mentioned, the system will be described here in relation to a case where only minimum necessary resources are employed.

The server WS is a server computer in which are prestored a great many items of content, such as a variety of programs and toy-operation-contents-related information. In response to an access request (e.g., designation of an uniform resource locator or URL) from the portable communication terminal MT, wired communication apparatus YT or other equipment, the server WS delivers, to the portable communication terminal MT, wired communication apparatus YT or other equipment, a requested one of the stored items of content such as a program and operation-contents-related information. URLs (Uniform Resource Locators), each functioning as an index to an item of content such as a program and toy-operation-contents-related information, are stored in combination with the respective items of content. Specifically, each of the URLs indicates the stored location of the corresponding item of content; namely, each of the URLs is an address (e.g., Internet address) imparted to allow each of the portable communication terminal MT and wired communication apparatus YT to access the item of content.

The wired communication apparatus YT is a personal computer or the like which is capable of carrying out wired communication with the server WS via the communication network X and storing or preserving each content, such as a program or toy-operation-contents-related information, received from the server WS. The portable communication terminal MT is a small-size terminal, such as a mobile cellular mobile phone or PDA (Personal Data (Digital) Assistant), capable of wireless communication. Similarly to the wired communication apparatus YT, the portable communication terminal MT is capable of receiving content, such as a program or toy-operation-contents-related information, from the server WS. When it is desired to receive content, such as a program or toy-operation-contents-related information, from the server WS by connecting the portable communication terminal MT to the server WS, the required communication is carried out through intervention of the base station KK. Namely, the base station KK relays signals to be communicated between the portable communication terminal MT and the server WS in such a manner that the portable communication terminal MT, by being connected to the communication network X, can communicate content, such as a program or toy-operation contents-related information, with the server WS. That is, the wired communication apparatus YT and portable communication terminal MT can be connected to the server WS via the communication network X such as a dedicated line network or Internet. Namely, because the server WS and the wired communication apparatus YT and portable communication terminal MT are connected with each other via the communication network X such as a LAN (Local Area Network), Internet or telephone line network, the user can transmit and receive content, such as a program or toy-operation-contents-related information, to and from the server WS, by connecting his or her wired communication apparatus YT or portable communication terminal MT to the communication network X. That is, bidirectional communication can be carried out between the user and the server WS.

It should be appreciated that a plurality of servers WS, wired communication apparatus YT and base stations KK may be connected to the communication network X. Also, the portable communication terminal MT may communicate content with any other portable communication terminal MT without intervention of the base station KK.

The electronic toy GN in accordance with the present invention is, for example, in the form of a stuffed doll of a dog, cat or the like, or a doll of a little girl, animation character or the like, which has, in appropriate positions thereof, a drive mechanism, sound generation mechanism, etc. including electronic circuitry, various sensors and driving motors. The electronic toy GN makes predetermined motions, utters predetermined words and produces predetermined musical and effect sounds, in response to detection by the sensors. Namely, on the basis of a toy-operation control program and in accordance with the type of each sensor having detected an external factor applied to the toy GN or a state of the toy GN, the electronic toy GN determines contents of each motion and sound to be made (such a motion and sound are collectively referred to as an "operation") and controls one or more components thereof in accordance with the thus-determined contents. For example, when the user touches a hand of the electronic toy GN, the sensor positioned in the toy's hand detects the touch, so that the toy GN moves the hand up and down as if it were shaking hands with the user. When the user speaks to the electronic toy GN, the sensor positioned in one of the toy's ears detects the voice of the user, so that the toy GN utters words like "konnichiwa (good day)" or "ohayo (good morning)", sings a predetermined song, or performs music.

Further, the electronic toy GN can receive and store desired content, such as a toy-operation control program or toy-operation-contents-related information, delivered from the server WS, via the wired communication apparatus YT or portable communication terminal MT. The electronic toy GN can also perform the operation on the basis of the received toy-operation control program, utter words and perform music in accordance with the received toy-operation-contents-related information. Further, the electronic toy GN allows the user to record his or her own voice in the toy GN and reproduce the thus-recorded user voice as toy-operation-contents content. Such specific arrangements of the electronic toy GN will be described later.

Note that the electronic toy GN of the present invention may be of any other type than the above-mentioned stuffed doll type shaped like a dog, cat or the like, or a doll type shaped like a little girl, animation character or the like; for example, the electronic toy GN may be of an electric train type shaped like a super express train or the like, a motor vehicle type shaped like a police car, ambulance or the like, a miniature musical instrument type shaped like a piano, violin or the like, or a clock or watch type.

Figure 2:
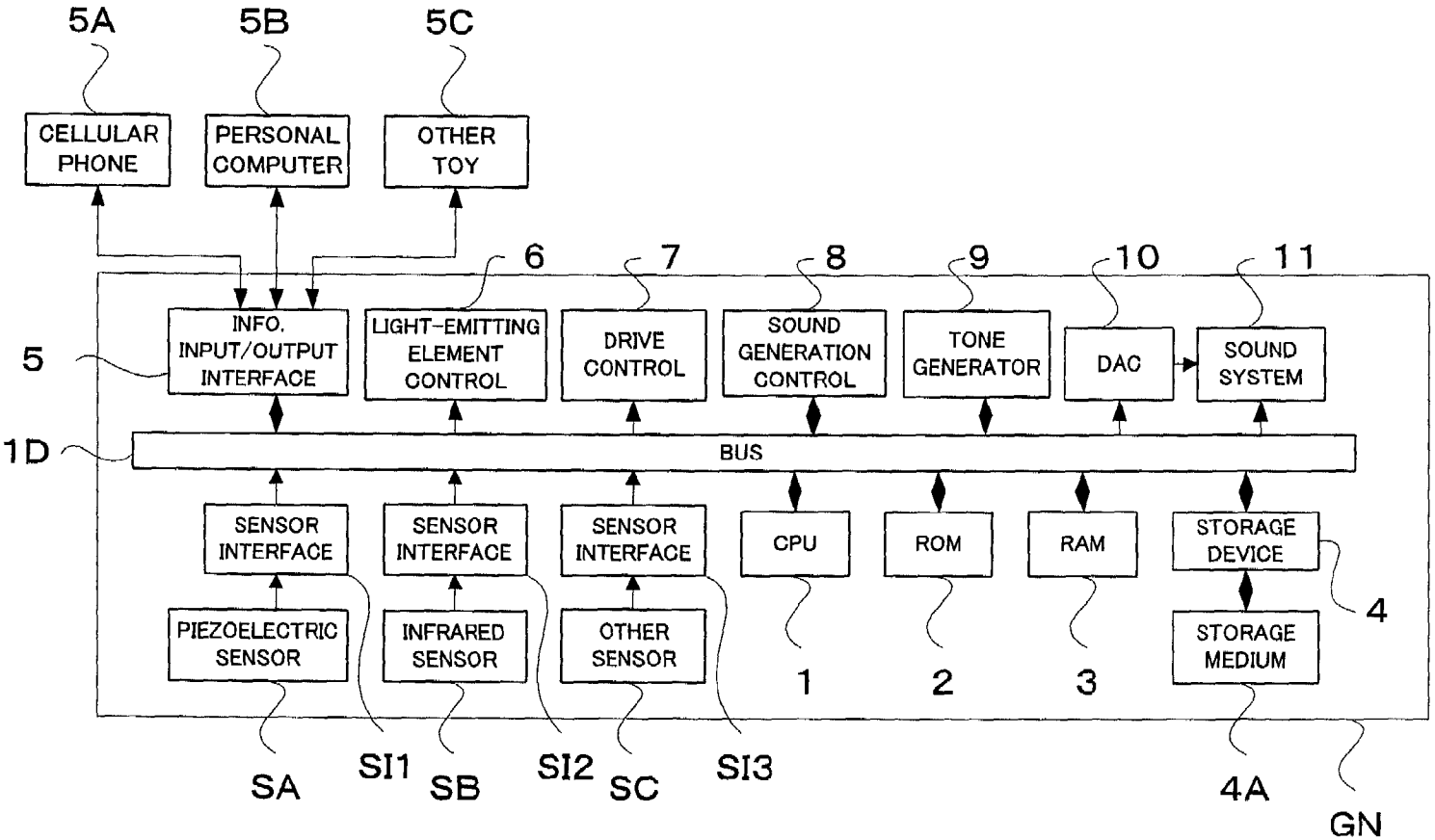
FIG. 2 is a block diagram showing an embodiment of a general hardware setup of the electronic toy in accordance with the present invention.

As stated above, the electronic toy GN of the prsent invention is designed to perform predetermined operations (motions and voices or sounds) in response to detection by various sensors installed in predetermined positions of the toy GN. For that purpose, the electronic toy GN can receive desired content, such as a toy-operation control program or toy-operation-contents-related information, from the server WS through wired or wireless communication by the wired communication device YT or portable communication terminal MT. Therefore, the following paragraphs briefly explain the general setup of the electronic toy GN, with reference to FIG. 2. FIG. 2 is a block digram showing an example of the general hardware setup of the electronic toy GN.

The electronic toy GN shown in FIG. 2 is controlled by a microcomputer including a microprocessor unit (CPU) 1, a read-only memory (ROM) 2 and a random-access memory (RAM) 3. The CPU 1 controls behavior of various components of the electronic toy GN. Namely, the respective behavior of the various components of the electronic toy GN is controlled by the CPU 1 carrying out various processing, such as a "toy-operation-contents confirmation" process for controlling the toy GN to perform a predetermined operation or reproduction of content on the basis of a predetermined toy-operation control program and a "special processing reception" process for receiving content, such as the predetermined toy-operation control program or toy-operation-contents-related information, from the server WS and storing the received content into the electronic toy GN. Details of the "toy-operation-contents confirmation" process and "special processing reception" process will be explained later in appropriate portions of the specification. To such a CPU 1, functioning to control the behavior of the various components, are connected, via a data and address bus 1D, the read-only memory (ROM) 2, random-access memory (RAM) 3, storage device 4, sensor interfaces SI1–SI3, information input/output interface 5, light-emitting element control section 6, drive control section 7, tone generation control section 8, DAC (Digital-to-Analog Converter) 10 and sound system 11.

The ROM 2 is provided for storing various content, such as toy-operation control programs and toy-operation-contents-related information, to be executed or referred to by the CPU 1. The RAM 3 is used as a working memory for temporarily storing content, such as a toy-operation control program or toy-operation-contents-related information, and various data generated as the CPU 1 executes the toy-operation control programs, a memory for storing a currently-executed toy-operation control program and data related to the currently-executed toy-operation control program, etc. Predetermined address regions of the RAM 3 are allocated to various functions and used as registers, flags, buffers, tables, memory, etc.

The storage device 4 is provided for storing various toy-operation control programs, toy-operation-contents-related information and other content, i.e. content such as toy-operation control programs themselves to be executed by the CPU 1 and toy-operation-contents-related information to be referred to by the CPU 1 during execution of the toy-operation control programs. In a case where a particular toy-operation control program is not stored in the ROM 2, the CPU 1 can be caused to operate in exactly the same way as in the case where the particular toy-operation control program is stored in the ROM 2, by prestoring the particular toy-operation control program in the storage device (e.g., hard disk device) 4 and loading the particular toy-operation control program from the storage device 4 into the RAM 3. Also, content, such as toy-operation control programs or toy-operation-contents-related information, received from the server WS via the wired communication device YT or portable communication terminal MT may be stored in the storage device 4. This arrangement greatly facilitates desired changes of content, including version upgrade of the content, such as a toy-operation control program or toy-operation-contents-related information, or addition of new content. The storage device 4 may use any of various removable-type storage media 4A other than the hard disk (HD), such as a floppy disk (FD), compact disk (CD-ROM or CD-RAM), magneto-optical disk (MO), digital versatile disk (DVD) and semiconductor memory.

The information input/output interface 5 is an interface that, for example, connects between a mobile cellular phone 5A and personal computer 5B and the electronic toy GN of the invention. With this information input/output interface 5, the electronic toy GN can connect to the server computer WS or the like via the communication network, such as a LAN (Local Area Network), Internet or telephone line network, and receive desired content such as a toy-operation control program and toy-operation-contents-related information. For example, in a case where desired content, such as a toy-operation control program or toy-operation-contents-related information, is not stored in the ROM 2, storage device (hard disk device) 4 or the like, the information input/output interface 5 is used to download the desired content from the server WS. Namely, in such a case, a command requesting the server WS to download the desired content such as a toy-operation control program and toy-operation-contents-related information, is first transmitted to the server WS via the information input/output interface 5 and communication network X. In response to the command, the server WS delivers the requested content, such as a toy-operation control program or toy-operation-contents-related information, to the electronic toy GN via the communication network X and the cellular phone 5A or personal computer 5B. The electronic toy GN then receives the desired content, such as a toy-operation control program or toy-operation-contents-related information, via the information input/output interface 5 and accumulatively store the received content into the storage device (hard disk device) 4 or the like. In this way, the necessary downloading of the desired content is completed. Also, by connecting another electronic toy 5C to the information input/output interface 5, content, such as a toy-operation control program or toy-operation-contents-related information, can be communicated with the other electronic toy 5C.

Note that the information input/output interface 5 and communication network X may be of a type capable of wired communication rather than wireless communication, or of a type capable of both wired and wireless communication.

The sensor interfaces SI1–SI3 are provided for inputting, to the electronic toy GN, detection signals output by the various sensors each having detected a particular external factor applied to the electronic toy GN or a particular state of the electronic toy GN. Namely, each of the toy-operation control programs determines an operation to be performed by the electronic toy GN, on the basis of the detection signals input via the sensor interfaces SI1–SI3. In the instant embodiment, an piezoelectric sensor SA, infrared sensor SB and other sensor SC are connected to the sensor interfaces SI1–SI3, respectively. The piezoelectric sensor SA detects a touch on the electronic toy GN, and the infrared sensor SB detects any object existing in the neighborhood of the electronic toy GN. The other sensor SC may be any one or more of a plurality of other sensors than the piezoelectric sensor SA and infrared sensor SB, such as an acceleration sensor, inclination sensor and stress sensor for detecting when the electronic toy GN has been moved, photo sensor for detecting a variation in brightness around the electronic toy GN, sound sensor for detecting presence/absence of a sound around the electronic toy GN, image sensor for detecting conditions around the electronic toy GN through image recognition.

Note that although the embodiment is shown as including three sensor interfaces SI1–SI3, any other suitable number of the sensor interfaces may be provided.

The light-emitting element control section 6 performs control to turn on (illuminate) or turn off (deilluminate) light-emitting elements, such as lamps or LEDs, attached to predetermined positions of the electronic toy GN. The drive control section 7 controls rotation of drive motors attached to joints of hands, neck, loins, etc. of the electronic toy GN. The sound generation control section 8 performs control to audibly produce a predetermined sound via the sound system 11 attached to the electronic toy GN, or silence (deaden) a predetermined sound being audibly generated. These control sections 6, 7 and 8 are in turn controlled on the basis of the toy-operation control programs executed by the CPU 1. For example, when toy operation contents have determined for moving a hand of the electronic toy GN up and down via an given one of the toy-operation control programs, the CPU 1 transmits, to the drive control section 7, a control instruction for rotating the drive motor provided in a position of the toy GN corresponding to a joint of the hand. Upon receipt of the control instruction, the control section 7 causes the drive motor to rotate, so that the hand of the electronic toy GN is moved up and down as instructed. Namely, each of the toy-operation control programs determines an operation to be performed by the electronic toy GN, in accordance with which one of the sensors connected to the sensor interfaces SI1–SI3 has detected a particular external factor or a particular state of the toy GN, as will be later described in detail.

The tone generator 9, which is capable of simultaneously generating tone signals in a plurality of channels, receives content comprising performance information, such as tone data or sound data, supplied via the data and address bus 1D and generates tone signals based on the received content. Each of the tone signals thus generated by the tone generator 9 is converted to an analog signal via the DAC 10 and then passed to the sound system 11, which audibly reproduces or sounds the analog tone signal. The tone data, i.e. musical performance data, may be in a digital coded format such as the MIDI format, or in a waveform sample data format such as the PCM, DPCM or ADPCM format. There may be provided an effect circuit (not shown) between the tone generator 9 and the sound system 11, so as to impart various effects to the tone signals generated by the tone generator 9. Further, any suitable tone signal generation method may be used by the tone generator 9 depending on an application intended. For example, any conventionally-known tone signal generation method may be used such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Other than the above-mentioned, the tone generator 9 may also use the physical model method where a sound waveform is synthesized by algorithms simulating a tone generation principle of a natural musical instrument; the harmonics synthesis method where a sound waveform is synthesized by adding a plurality of harmonics to a fundamental wave; the formant synthesis method where a sound waveform is synthesized by use of a formant waveform having a specific spectral distribution; or the analog synthesizer method using a combination of VCO, VCF and VCA. Further, the tone generator 9 may be implemented by a combined use of a DSP and microprograms or of a CPU and software programs, rather than by use of dedicated hardware. The plurality of tone generating channels may be implemented by using a single circuit on a time-divisional basis, or by providing a separate circuit for each of the channels.

Note that the electronic toy GN is not limited in construction to the above-described. For example, the electronic toy GN may also include a display in the form of a liquid crystal display (LCD), cathod ray tube (CRT) or the like so as to visually display textual information, such as lyrics and message of a music piece, based on supplied content, or various control information such as a state of the electronic toy GN or a controlling state of the CPU 1.

Figure 3:
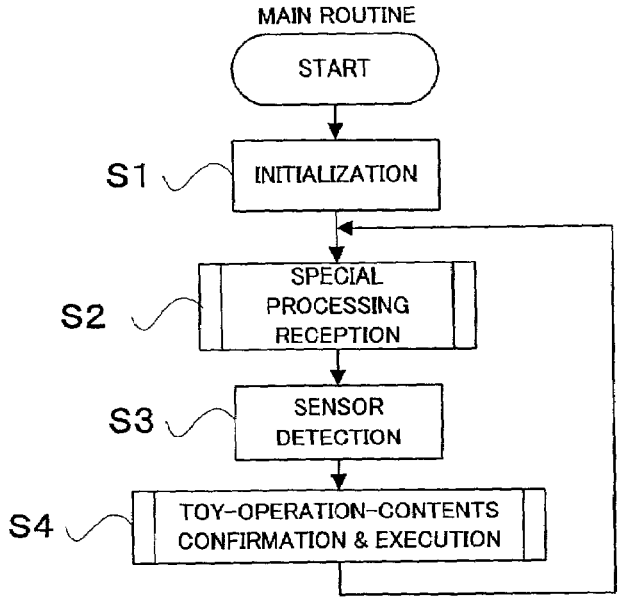
FIG. 3 is a flow chart showing an exemplary operational sequence of a main routine carried out by a CPU of the electronic toy of the present invention.

FIG. 3 is a flow chart showing an exemplary operational sequence of a main routine carried out by the CPU 1 of the electronic toy GN of the present invention. The operational sequence of the main routine will be described below with reference to FIG. 3. The main routine is started up by turning on a power switch of the electronic toy GN and terminated by turning off the power switch.

First, the electronic toy GN is initialized at step S1. For example, various memories of the electronic toy GN are cleared to respective initial states. At step S2, the "special processing reception" process is carried out. This "special processing reception" process is a process for inputting/outputting content, such as a toy-operation control program or toy-operation-contents-related information, which is carried out by the electronic toy GN being connected to the cellular phone 5A, personal computer 5B, other electronic toy 5C or the like. In this "special processing reception" process, the CPU 1 receives and stores content, such as a toy-operation control program or toy-operation-contents-related information, stored in the server WS, cellular phone 5A, personal computer 5B, other electronic toy 5C or the like, connected via the information input/output interface 5 to the electronic toy GN, as will be later described in detail.

At step S3, a sensor detection process is performed. Namely, at step S3, a determination is made as to whether any one or more of the sensors installed in the predetermined positions of the electronic toy GN have detected a particular external factor or a particular state of the toy GN, and, if so, with what intensity the one or more sensors have detected the particular external factor or the particular state of the toy GN. Then, at step S4, an operation to be performed by the electronic toy GN is determined in accordance with the type and detected intensity of the one or more sensors having detected the external factor or the state of the toy GN. Specifically, at step S4, a "toy-operation-contents confirmation and execution" process is carried out. This "toy-operation-contents confirmation and execution" process is a process for determining an operation to be now performed by the electronic toy GN on the basis of the type of the one or more sensors having detected the external factor or the state of the toy GN, a combination of the sensors having detected the external factor or the state of the toy GN, previous operational states of the toy GN, etc., and then causing the electronic toy GN to perform the thus-determined operation. For example, in a sitiation where none of the sensors has detected anything for the past ten hours and when predetermined ones of the sensors have detected that "it is light" and "there is some person near the electronic toy GN", the electronic toy GN is controlled to utter selected predetermined words or phrase like "ohayo (good morning)". When a predetermined one of the sensors has detected a "soft touch", the electronic toy GN is controlled to perform a predetermined operation, e.g. wag its tail. Details of this "toy-operation-contents confirmation and execution" process will be described later.

Figure 4:
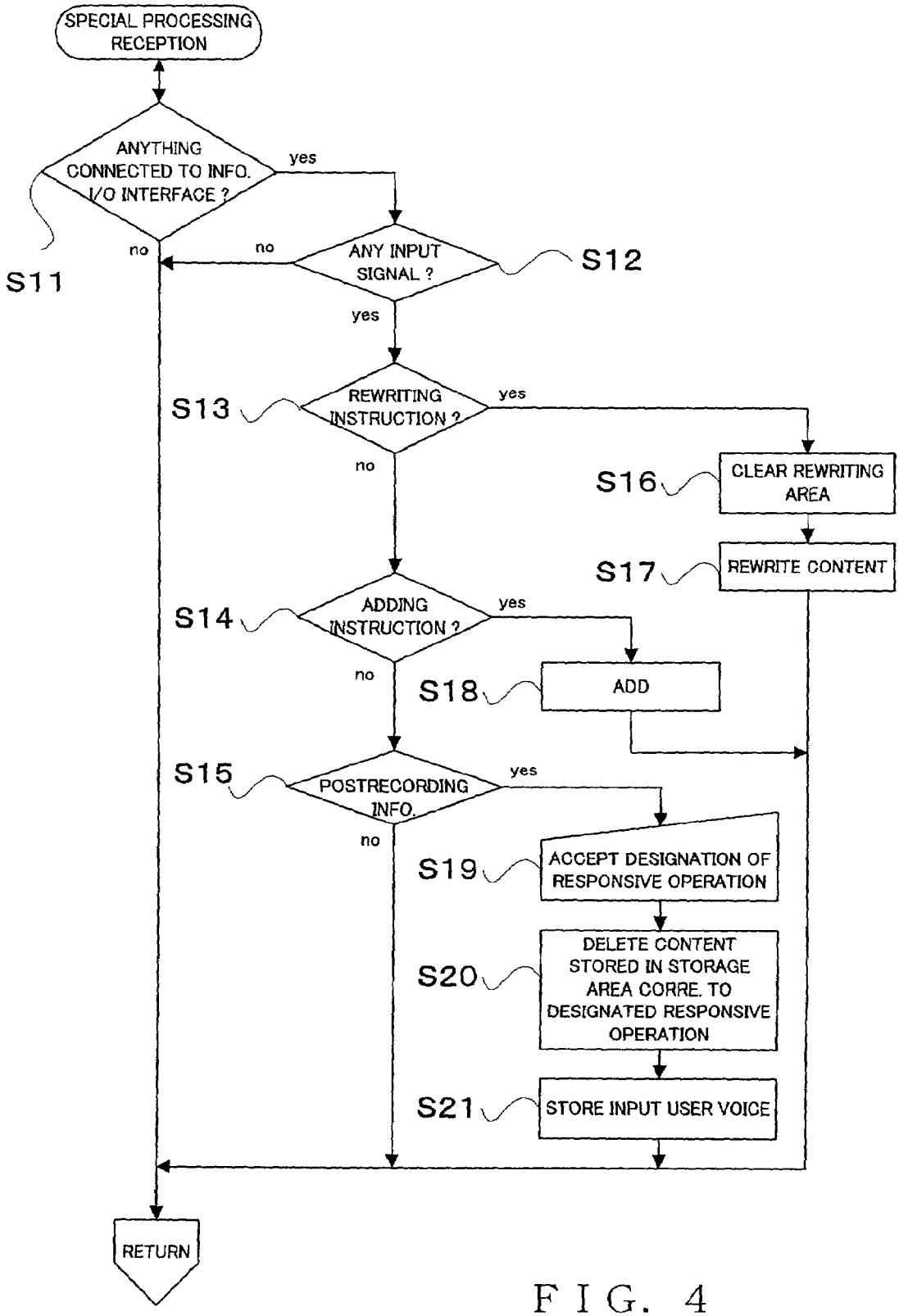
FIG. 4 is a flow chart showing an exemplary operational sequence of a "special processing reception" process carried out during the course of the main routine of FIG. 3.

The following paragraphs describe details of the "special processing reception" process (step S2 in the main routine of FIG. 3), with reference to FIG. 4 that is a flow chart showing an exemplary operational sequence of the "special processing reception" process.

At step S11, a determination is made as to whether there is anything currently connected to the information input/output interface 5 of the electronic toy GN, i.e., whether any one of the cellular phone 5A, personal computer 5B, other electronic toy 5C and the like is currently connected to the information input/output interface 5. If none of the cellular phone 5A, personal computer 5B, other electronic toy 5C and the like is currently connected to the information input/output interface 5 (NO determination at step S11), the "special processing reception" process is brought to an end without performing any other operation. Namely, when none of the cellular phone 5A, personal computer 5B, other electronic toy 5C and the like is currently connected to the information input/output interface 5 of the toy GN, no access can be made to the server WS via the communication network X, so that any content, such as a toy-operation control program or toy-operation-description information, can not be received from the server WS, or any content, such as a toy-operation control program or toy-operation-contents-related information, stored in the cellular phone 5A, personal computer 5B or other electronic toy 5C can never be transmitted to or received from the electronic toy GN. Thus, if nothing is currently connected to the information input/output interface 5 of the electronic toy GN as determined at step S11, the "special processing reception" process is brought to an end. If any operation has been performed so far by the electronic toy GN, the same operation is caused to continue, because no new operation is selected in this case.

If, on the other hand, any one of the cellular phone 5A, personal computer 5B, other electronic toy 5C and the like is currently connected to the information input/output interface 5 of the electronic toy GN (YES determination at step S11), it is further determined at step S12 whether the electronic toy GN has received any input signal from the cellular phone 5A, personal computer 5B, other electronic toy 5C or the like. If the input signal has been received (YES determination at step S12) and the input signal is a "rewrite" instructing signal (e.g., setting signal DTMF of value "1" generated by the cellular phone 5A in response to operation on its ten-button keypad) as determined at step S13, the CPU 1 completely clears a rewriting area provided in the RAM 3 or storage device 4 at step S16, so as to write content, such as a toy-operation control program or toy-operation-contents-related information, into the rewriting area at step S17. Namely, in this case, data in the rewriting area are completely replaced with new data.

If the input signal has been received (YES determination at step S12) and the input signal is an "addition" instructing signal (e.g., setting signal DTMF of value "2" generated by the cellular phone 5A in response to operation on its ten-button keypad) as determined at step S14, the CPU 1 additionally stores new content, such as a toy-operation control program or toy-operation-contents-related information, into the RAM 3 or storage device 4 at step S18. Namely, in this case, it is possible to use an additional toy-operation control program containing data of a new operation and additional information related to new words and music.

Further, if the input signal has been received (YES determination at step S12) and the input signal is an "post-recording" instructing signal (e.g., setting signal DTMF of value "3" generated by the cellular phone 5A in response to operation on its ten-button keypad) as determined at step S15, the CPU 1 sets the electronic toy GN to accept designation of an responsive operation at step S19, deletes content currently stored in a storage area corresponding to the designated responsive operation at step S20, and then, in response to input of a user voice, stores the user voice as content at step S21. In this case, upon receipt of the setting signal DTMF of "3", the electronic toy GN is placed in a state waiting for a user input, so that when the user causes a desired one of the sensors to respond and inputs his or her voice under the waiting state of the toy GN, the input user voice can be registered so that it can be sounded in response to a predetermined operation at a desired later time. This way, the user, by just performing simple setting operation, can cause the electronic toy GN to automatically produce the user voice in response to detection, by the predetermined sensor, of a corresponding external factor or state of the toy.

Note that at step S21, the input user voice may be recorded in the electronic toy GN through a microphone mounted on the toy GN. Alternatively, a desired user voice recorded in the cellular phone 5A through a voice recording function of the phone 5A may be transmitted to and recorded in the electronic toy GN. By thus recording the user voice, the user is allowed to present another party with the electronic toy GN having a message recorded therein with his or her own voice.

Figure 5:
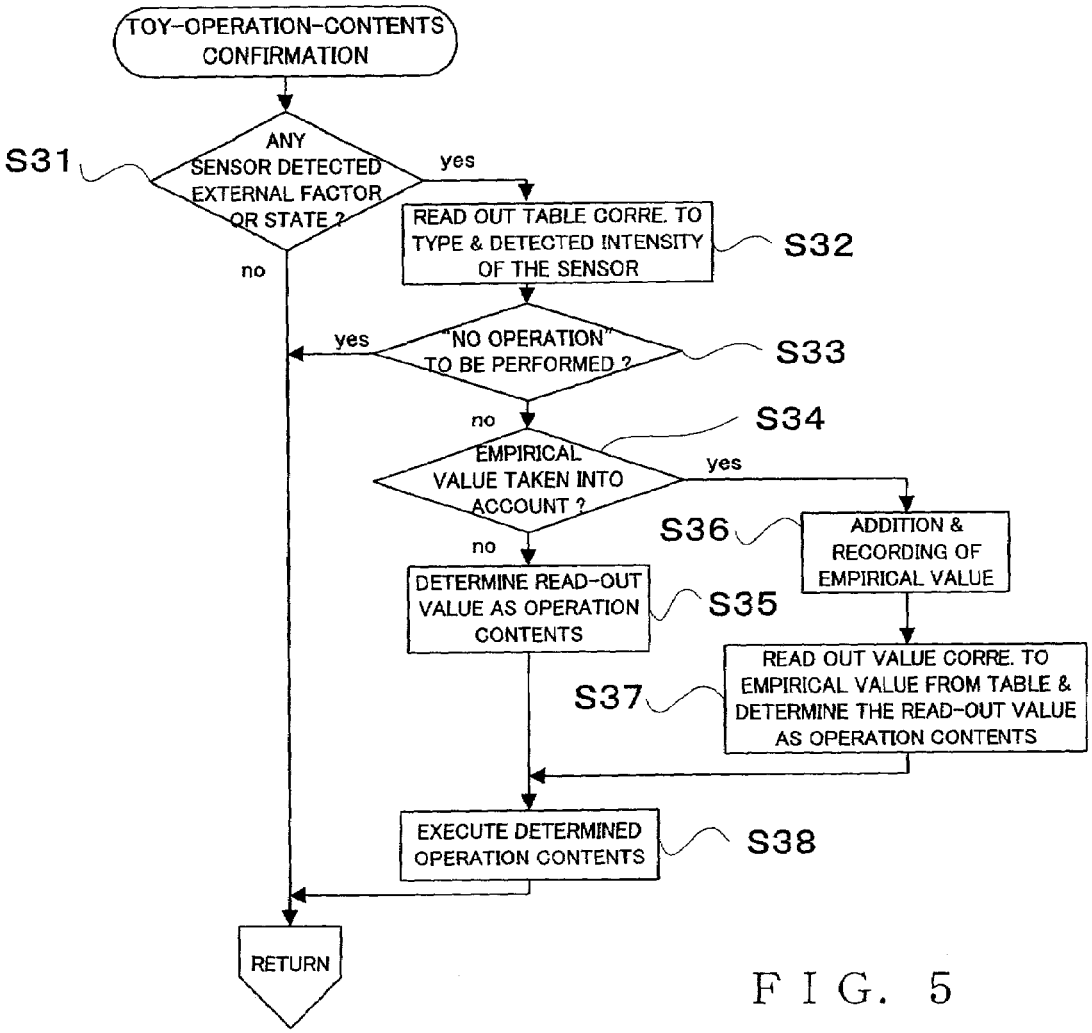
FIG. 5 is a flow chart showing an exemplary operational sequence of a "toy-operation-contents confirmation" process carried out during the course of the main routine of FIG. 3.

Next, details of the "toy-operation-contents confirmation and execution" process (step S4 of FIG. 3) will be described, with reference to FIG. 5 that is a flow chart showing an exemplary operational sequence of the "toy-operation-contents confirmation and execution" process carried out during the course of the main routine.

At step S31, a determination is made as to whether any of the sensors installed in the electronic toy GN has detected a particular external factor or a particular state of the toy GN. If none of the sensors has detected a particular external factor or a particular state of the toy GN (NO determination at step S31), then the "toy-operation-contents confirmation and execution" process is brought to an end; namely, in this case, the electronic toy GN either performs no operation at all or continues to perform a current operation. If, on the other hand, any of the sensors has detected a particular external factor or a particular state of the toy GN (YES determination at step S31), a table corresponding to the type and detected intensity of the sensor is read out from the ROM 2, RAM 3 or the like at step S32. Namely, once any of the sensors has detected any particular external stimulus applied to the toy GN or a particular state of the toy GN (e.g., having detected that the electronic toy GN has been lifted or spoken to), reference is made to a table (i.e., toy-operation-contents determining table to be later described) on the basis of the type and detected intensity of the sensor, so that content is extracted on the basis of the toy-operation-contents determining table. If the content thus read out in accordance with the type and detected intensity of the sensor is representative of "no operation to be performed" (YES determination at step S33), then the "toy-operation-contents confirmation and execution" process is brought to an end; that is, in this case, the electronic toy GN performs no operation at all or ceases a currently-performed operation. Such content representative of "no operation to be performed" is normally read out, for example, when the sensor has detected the corresponding factor or state in the dark, has detected only a variation in the environmental brightness, or has detected the corresponding factor or state in combination with another particular one of the sensors. If the content thus read out in accordance with the type and detected intensity of the sensor is not representative of "no operation to be performed" (NO determination at step S33), i.e. if the content is meaningful content, it is further determined at step S34 whether the read-out content takes account of an empirically-obtained value (empirical value). If answered in the affirmative at step S34, the empirical value is added to an empirical value so far accumulated in the RAM or the like and the resulting sum is recorded at step S36. Then, contents of an operation to be performed by the electronic toy GN are determined in correspondence with the empirical value at step S37. If, on the other hand, the read-out content takes account of no empirical value, (NO determination at step S34), the read-out content is determined as contents of an operation. Once the content has been determined like this, the determined content is executed at step S38. In case some other operation is already being performed and this operation is of the same as the operation based on the determined content, the time period set for the other operation is extended, i.e. the other operation is caused to continue. If, on the other hand, the other operation already being performed is not of the same as the operation based on the determined content, the operation based on the determined content is performed in parallel with the other operation, or the other operation is terminated so that only the operation based on the determined content is performed alone.

The following paragraphs briefly explain the above-mentioned toy-operation-contents determining table, with reference to FIG. 6 that conceptually showing an exemplary format of the toy-operation-contents determining table. More specifically, FIG. 6A shows a standard toy-operation-contents determining table, i.e. a table stored in a storage area of the ROM 2 or the like, and FIG. 6B shows a rewritable toy-operation-contents determining table, i.e. a table stored in a rewritable storage area (or rewriting area) of the RAM 3 or the like. When reference is to be made to the toy-operation-contents determining table during the above-described "toy-operation-contents confirmation and execution" process (step S32 or S37 of FIG. 5), the rewritable toy-operation-contents determining table stored in the rewritable storage area of the RAM 3 or the like is referred to with priority, and then the standard (i.e., non-rewritable) toy-operation-contents determining table stored in the storage area of the ROM 2 or the like is referred to.

Each toy-operation-contents determining table is a table storing sensor types and operation types corresponding to the sensor types; the sensor types correspond to the operation types on a one-to-one basis. In the illustrated example, the sensor types are represented by capital alphabetical letters "A", "B", "C", etc., the toy-operation control programs to be executed in correspondence with the sensor types are represented by small alphabetical letters "a", "b", "c", etc., and toy-operation-contents-related information related to contents of operations to be performed via the toy-operation control programs are represented by "1"–"6", for convenience of illustration.

First, the standard toy-operation-contents determining table shown in FIG. 6A is explained. To facilitate understanding of the following explanation, let it be assumed that sensor "A" represents the photo sensor, sensor "B" the inclination sensor and sensor "C" the infrared sensor. Further, assume that operation "a" represents a toy-operation control program for causing the electronic toy GN to speak or perform music, in which case operation contents "1" represent words "ohayo (good morning)", operation contents "2" represent words "konnichiwa (good day)" and operation contents "3" represent "music 1". Further, assume that operation "b" represents a toy-operation control program for causing the electronic toy GN to sparkle its eyes, in which case operation contents "1" represent "illumination" and operation contents "2" represent "blinking". Furthermore, assume that operation "c" represents a toy-operation control program for causing the electronic toy GN to move its tail, in which case operation contents "1" represent "lifting" and operation contents "2" represent "wagging".

Because no "operation type" corresponding to sensor "A" is defined in the standard toy-operation-contents determining table of FIG. 6A (as indicated by "–" in the figure), the electronic toy GN performs no operation when only the photo sensor has detected the corresponding external factor. Further, because the operation type corresponding to sensor "A+B" is a(1), the electronic toy GN says "ohayo" when the photo sensor and inclination sensor have detected the corresponding external factor and state. Further, because the operation type corresponding to sensor "A+C" is a(2)b(1), the electronic toy GN says "konnichiwa" while blinking its eyes, when the photo sensor and infrared sensor have detected the corresponding external factors. Further, because the operation type corresponding to sensor "A+B+C" is "random" (denoted as undetermined in the figure), the electronic toy GN operates in accordance with a combination of randomly-selected operation contents (or only single operation contents), when the photo sensor, inclination sensor and infrared sensor have detected the corresponding external factor and state. Furthermore, because the operation type corresponding to sensor "B" is c(1), the electronic toy GN lifts its tail when only the inclination sensor has detected the corresponding state. Furthermore, because the operation type corresponding to sensor "B+C" is b(2)c(2), the electronic toy GN wags its tail while blinking its eyes, when the inclination sensor and infrared sensor have detected the corresponding state and external factor. Furthermore, because the operation type corresponding to sensor "C" is a(3)c(1), the electronic toy GN lifts its tail and plays music 1 when only the infrared sensor has detected the corresponding external factor.

Next, the rewritable toy-operation-contents determining table shown in FIG. 6B is explained. In the illustrated example of FIG. 6B, the operation type corresponding to sensor "A+B" is a(5) that is different from the counterpart in FIG. 6A; in this case, the electronic toy GN operates in accordance with operation contents a(5), rather than saying "ohayo", when the photo sensor and inclination sensor have detected the corresponding external factor and state. Further, because the operation type corresponding to sensor "A+B+C" is a(6)b(3) that is different from the counterpart in FIG. 6A; in this case, the electronic toy GN operates in accordance with operation contents a(6) and b(3), rather than operating in accordance with a combination of randomly-selected operation contents (or single operation contents), when the photo sensor, inclination sensor and infrared sensor have detected the corresponding external factor and state. Furthermore, the operation type corresponding to sensor "D" is c(3) that is not defined in the table of FIG. 6A; that is, operation type c(3) is an additional or new setting added to the toy-operation-contents determining table of FIG. 6B, so that the electronic toy GN operates in accordance with operation contents c(3) only when sensor "D" has detected the corresponding external factor or state.

Whereas data rewriting or addition to the toy-operation-contents determining table has been described, data rewriting or addition may be performed on the above-described "toy-operation-contents confirmation and execution" process itself. Namely, the "toy-operation-contents confirmation" process, intended for determining a toy-operation control program to be executed and controlling the electronic toy GN in accordance with the determined toy-operation control program, may be carried out in an operational flow different from that shown in FIG. 5, the "toy-operation-contents confirmation" process itself may be added as a new program to the RAM.

Further, although the above-described embodiment is constructed to transmit or receive a desired toy-operation control program and toy-operation-contents-related information to or from the server WS, cellular phone 5A, personal computer 5B or other electronic toy 5C, the toy-operation-contents determining table may of course be transmitted or received to or from the server WS, cellular phone 5A, personal computer 5B or other electronic toy 5C.

It should also be appreciated that musical performance information in musical content may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event.

Furthermore, where performance information for a plurality of channels are handled in the present invention, the performance information for the plurality of channels may be stored together in a mixture or the performance information for the channels may be separated from each other on a track-by-track basis.

In summary, the present invention not only causes an electronic toy to move, produce sound etc. in accordance with a prestored program and toy-operation-contents-related information, but also causes the electronic toy to perform a new operation in accordance with content, such as a prestored program or toy-operation-contents-related information, created outside the toy and received via a communication line. With such novel arrangements, the present invention can advantageously provide an electronic toy that will not bore an user even if the toy is used for a long period of time.

Further, with the arrangement that content, such as a prestored program or toy-operation-contents-related information, created outside the toy is received via the communication line and stored in memory, the present invention achieves another superior benefit that it allows the electronic toy to perform a great many operations without requiring a great storage capacity.

What is claimed is:

1. An electronic toy comprising:

at least one sensor that detects an external stimulus applied to said electronic toy;

an input interface that receives, from outside said electronic toy, control information for controlling said electronic toy;

a memory that stores the control information received via said input interface; and a processor coupled with said memory and adapted to:

read out control information from said memory, in response to an external stimulus detection signal generated by said sensor; and control said electronic toy to perform a predetermined operation in accordance with the control information read out from said memory, wherein said control information received from outside said electronic toy and stored in said memory includes a program for causing said electronic toy to perform a predetermined operation, and wherein the program stored in said memory is selectively read out from said memory in accordance with a type of external stimulus detected by said sensor, wherein said processor is further adapted to generate an accumulative empirical value on the basis of the external stimulus detection signal generated by said sensor and read out control information from said memory in accordance with the empirical value, and wherein said input interface further receives, from outside said electronic toy, first instructing information that the received control information should be additionally stored in said memory.

2. An electronic toy as claimed in claim 1 wherein said input interface comprises a communication interface having a communication function.

3. An electronic toy as claimed in claim 2 wherein said communication interface is connected to an external communication terminal so as to receive control information via the external communication terminal.

4. An electronic toy as claimed in claim 1 which further comprises a sound generating mechanism, and the predetermined operation performed by said electronic toy is to audibly produce predetermined words, musical sound or effect sound via said sound generating mechanism.

5. An electronic toy as claimed in claim 1 which further comprises a moving mechanism, and the predetermined operation performed by said electronic toy is to make a motion via said moving mechanism in accordance with the control information.

6. An electronic toy as claimed in claim 1 which further comprises a sound generating mechanism and a moving mechanism, and the predetermined operation performed by said electronic toy is to audibly produce predetermined words, musical sound or effect sound via said sound generating mechanism and make a motion corresponding to the words or sound via said moving mechanism.

7. An electronic toy as claimed in claim 1 wherein the program includes information representative of predetermined words, musical sound or effect sound to be audibly produced.

8. An electronic toy as claimed in claim 7 wherein the program includes a control program for causing said electronic toy to make successive motions.

9. An electronic toy as claimed in claim 1 wherein the empirical value is accumulated for each type of the external stimulus detection signal, and control information is read out from said memory for each type of the empirical value or in accordance with a combination of types of the empirical value.

10. An electronic toy as claimed in claim 1 wherein said input interface further receives, from outside said electronic toy, second instructing information for instructing that predetermined control information having been stored in said memory should be replaced with the received control information.

11. An electronic toy as claimed in claim 3 wherein said external communication terminal is a mobile communication terminal.

12. A method for controlling an electronic toy, said electronic toy including at least one sensor that detects an external stimulus applied to said electronic toy, an input interface that receives, from outside said electronic toy, control information for controlling said electronic toy, and a memory that stores the control information received via said input interface, said method comprising:

a step of reading out control information from said memory, in response to an external stimulus detection signal generated by said sensor; and a step of controlling said electronic toy to perform a predetermined operation in accordance with the control information read out from said memory, wherein said control information received from outside said electronic toy and stored in said memory includes a program for causing said electronic toy to perform a predetermined operation, and wherein the program stored in said memory is selectively read out from said memory in accordance with a type of the external stimulus detected by said sensor, wherein said method further comprises the steps of generating an accumulative empirical value on the basis of the external stimulus detection signal generated by said sensor and reading out control information from said memory in accordance with the empirical value, and wherein said input interface further receives, from outside said electronic toy, instructing information that the received control information should be additionally stored in said memory.

13. A computer program comprising computer program code means for performing all the steps of claim 12 when said program is run on a computer or processor provided in said electronic toy.

* * * * *